United States Patent [19]

Allen

[11] Patent Number: 4,941,272

[45] Date of Patent: Jul. 17, 1990

[54] ORTHOPEDIC FOOTBRACE

[75] Inventor: Don T. Allen, 4406 Oxford Way, Norman, Okla. 73072

[73] Assignee: Don T. Allen, Norman, Okla.

[21] Appl. No.: 342,332

[22] Filed: Jun. 30, 1989

[51] Int. Cl.[5] ..... A43B 7/19

[52] U.S. Cl. ..... 36/91; 128/586; 128/607; 128/609; 128/614

[58] Field of Search ..... 36/91, 78, 37, 38; 128/586, 587, 588, 589, 590, 591, 592, 593, 607, 608, 609, 610, 611, 614, 615, 616, 617, 621, 622, 623

[56] References Cited

U.S. PATENT DOCUMENTS

| | | | |
|---|---|---|---|
| 1,907,612 | 5/1933 | Tarlow | 128/590 |
| 2,163,260 | 6/1939 | Netkowski | 178/591 |
| 2,447,603 | 8/1948 | Snyder | 128/592 |

*Primary Examiner*—Paul T. Sewell
*Assistant Examiner*—Andrew D. Meyers

[57] ABSTRACT

The normal oxford type shoe of a man or woman includes a sole and heel. A separate heel is usually attached to the back half of the sole. Most shoes have some arch support built in the shoe to conform to the arch of the foot. The improvement comprises a heel connected to a plate under the arch and a spring steel plate under the arch and the heel area. The original heel of the shoe is removed.

1 Claim, 1 Drawing Sheet

ORTHOPEDIC FOOTBRACE

FIELD OF THE INVENTION

My invention relates to shoes worn by mankind, and more particularly to the support the shoe provides for the foot.

DESCRIPTION OF THE PRIOR ART

Shoes worn by men and women of

There is then more pressure placed on the heel and less pressure on the front of the foot thereby causing improper balance. This can bring about pain to the heel.

Various products have been on the market for several years to alleviate this problem. One is the arch support. This instrument, sometime padded, is placed in the shoe to keep the arch higher when standing or walking. In many cases this is beneficial, however it does not balance the foot completely and more than normal pressure is usually placed on the heal causing discomfort to the heel. The other most common is the padded sole placed in the shoe. This instrument also helps in some cases but does nothing to balance the foot and relieve excess pressure to the heel. Many people of various occupations are required to stand on their feet for long periods of time. If they have fallen arches they will in most cases have discomfort to their feet.

SUMMARY OF THE INVENTION

My invention provides a better balance to the foot when walking or standing. While walking the first contact to floor or ground is made by the extended heel. When pressure is applied the arch plate is lifted therefore lifting the arch. At the same time the heel is cushioned by the spring heel allowing the heel to come down and bring about balance to the foot. This same condition takes place while standing.

Two changes must be made to the normal oxford type shoe. The heel must be removed and a one-half inch foam sole must be attached to the front approximate four tenths of the sole. This foam is attached to the sole that the shoe was built with.

DESCRIPTION OF THE EMBODIMENTS

Figure 1:
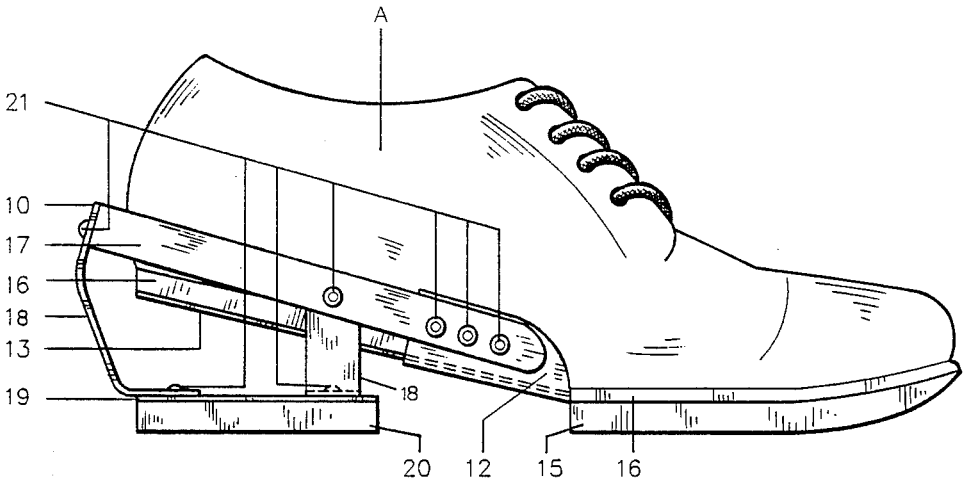
FIG. 1 is a side view of the orthopedic foot brace and shoe.
Figure 2:
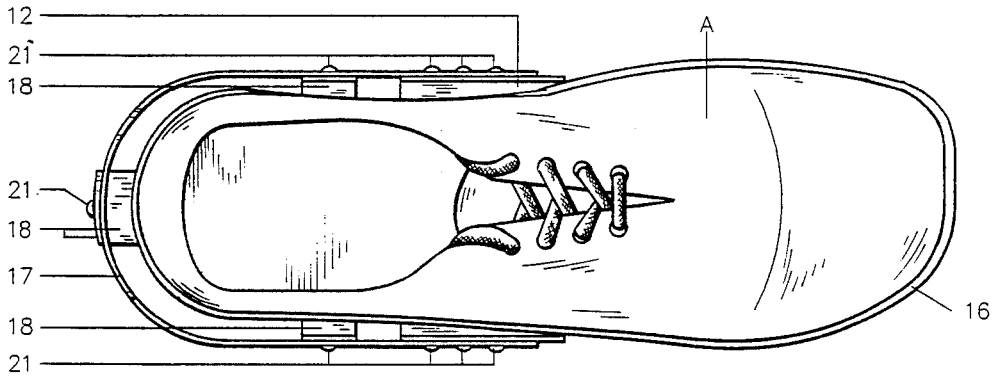
FIG. 2 is a top view of the orthopedic foot brace and shoe.

The Orthopedic foot brace, generally designated 10, will be used by individuals with fallen arches or as they are more commonly called "flat feet." This brace can be installed on most oxford type shoes. The heel of the shoe must be removed and a one-half inch foam sole 15 must be added to the front approximate four-tenths of the original shoe sole 16 that the shoe was built with.

The Orthopedic foot brace is fabricated from 1/16" thick stainless steel, spring steel, nylon heal and 3/16" steel pop rivets.

A heel plate 19 is fabricated ⅛" larger on each side than the original heel. ¾" wide heel plate braces 18 are connected to the heel plate 19 with 3/16" steel pop rivets 21. One heel plate brace 18 is connected from the back of the heel plate 19 and two heel plate braces 18 are connected from each side of the heel plate 19. The heel plate braces 18 are bent in a 90 degree angle and lap onto the top of the heel plate 1". They are connected with one 3/16" steel pop rivet each 21. A nylon heel 20 is attached to the heel plate 19 with three 3/16" steel pop rivets 21. The heel plate braces 18 are then connected to the inside of the ¾" wide heel-arch plate brace 17 with one 3/16" steel pop rivet 21 each.

The heel-arch plate brace is then connected to the arch lift plate 12. The arch lift plate 12 is 2½" deep front to back and each side is bent up at a 90 degree angle 1." The width of the arch lift plate 12 is determined by the width of the individual original shoe sole 16. Shoe sole width will vary. The heel-arch plate braces 17 are attached to the turned up 1" sections of the arch lift plate 12 with two 3/16" steel pop rivets 21 each.

The heel-arch plate braces 17 are connected to the outside of the arch lift plate 12.

One, two or three pieces of spring steel plate 50 thousandths thick 13 are put between the arch lift plate 12 and the original shoe sole 16. The number of spring steel plates 13 depends on the weight of the individual. The spring plates 13 are cut to the width and length of the original shoe sole 16 that is not covered by the one half inch foam sole 16.

Figure 3:
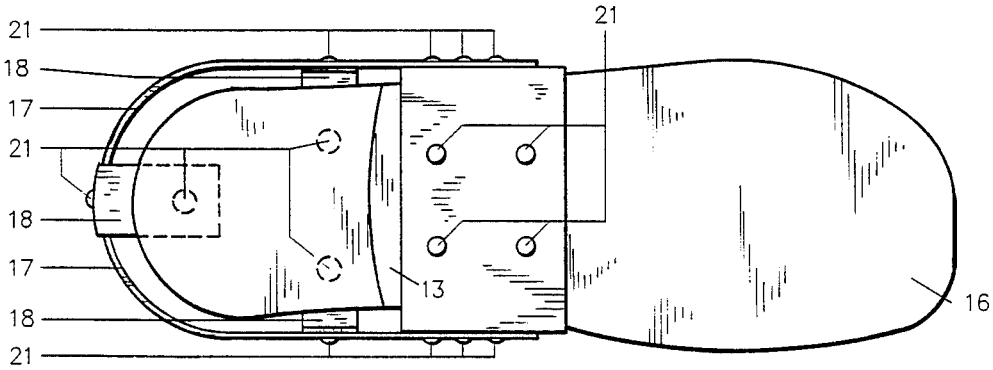
FIG. 3 is a bottom view of the orthopedic foot brace and shoe.

The arch lift plate 12 and the spring steel plates 13 are connected to the oxford type shoe A with two 3/16" steel pop rivets 21 ⅜" from the back of the one-half inch foam sole 15. See FIG. 3, and two 3/16" steel pop rivets ⅜" from the back of the arch lift plate 12. See FIG. 3. The distance apart of the 3/16" steel pop rivets will be averaged out, determined by the width of the arch lift plate 12.

I claim:

1. A foot brace (10) comprising:

an oxford-type shoe (A) having a sole (16) connected to the bottom thereof and a shoe heel portion, an arch lift plate (12) connected to the bottom of the sole (16) at the region of the shoe arch, A steel spring (13) connected between the sole (16) and the arch lift plate (12) to allow the shoe heel portin to flex downwardly, an arch plate brace (17) connected to the arch lift plate (12) and extending rearwardly therefrom, a plurality of heel plate braces (18) extending down from the arch plate brace (17) and connected to a heel plate (19) and a heel (20) connected to the heel plate (19) whereby the arch lift plate (12) is connected to the heel (20) which is disconnected from the shoe heel portion and is supported soley by the arch lift plate (12).

* * * * *